United States Patent [19]

Haytayan

[11] Patent Number: 4,525,902

[45] Date of Patent: Jul. 2, 1985

[54] METHOD AND MEANS FOR ATTACHING INSULATION TO A MOLD

[75] Inventor: Harry M. Haytayan, Lincoln, Mass.

[73] Assignee: Pneutek, Inc., Hudson, N.H.

[21] Appl. No.: 594,393

[22] Filed: Mar. 26, 1984

Related U.S. Application Data

[62] Division of Ser. No. 368,659, Apr. 15, 1982.

[51] Int. Cl.[3] ..... E04B 1/38; F16B 5/06

[52] U.S. Cl. ..... 24/350; 24/380; 24/563; 24/295; 411/461; 52/714

[58] Field of Search ..... 24/350, 380, 543, 563, 24/295; 411/457, 458, 461, 466; 52/597, 714; 292/83; 312/140.4, 214

[56] References Cited

U.S. PATENT DOCUMENTS

| | | | |
|---|---|---|---|
| 990,209 | 4/1911 | MacKenzie | 411/461 |
| 1,537,952 | 5/1925 | Kridler et al. | 24/350 |
| 2,163,381 | 6/1939 | Marsan | 52/598 |
| 2,317,428 | 4/1943 | Anderson | 52/714 |
| 3,208,119 | 9/1965 | Seckerson | 24/295 |
| 3,288,506 | 11/1966 | Cline | 24/563 |
| 3,300,924 | 1/1967 | Ashby et al. | 52/714 |
| 3,836,106 | 9/1974 | Gray | 24/350 |
| 3,864,889 | 2/1975 | Hobbs | 24/350 |
| 4,439,970 | 4/1984 | Rosner | 411/461 |

FOREIGN PATENT DOCUMENTS

| | | | |
|---|---|---|---|
| 707473 | 4/1965 | Canada | 52/714 |
| 1009056 | 11/1965 | United Kingdom | 24/295 |

*Primary Examiner*—Victor N. Sakran

*Attorney, Agent, or Firm*—Schiller & Pandiscio

[57] ABSTRACT

Novel method and means for securely attaching a liner of insulation boarding to the mold cap of a two-piece ingot mold, in order that the ingot mold will be capable of producing substantially void-free ingots.

1 Claim, 6 Drawing Figures

METHOD AND MEANS FOR ATTACHING INSULATION TO A MOLD

Division of Ser. No. 368,659, 4-15-82.

FIELD OF THE INVENTION

This invention relates to steel production in general, and more particularly to methods and means for casting steel in large ingots.

BACKGROUND OF THE INVENTION

Conventional steel-making techniques often call for taking the molten metal of an initial steel melt and pouring it into large molds so as to cast giant ingots. These ingots can then be easily shipped and/or stored as desired. Later, the ingots are remelted and the steel obtained therefrom utilized in specific manufacturing operations.

For obvious reasons, it is generally preferred that the giant ingots be formed substantially free of large voids. Now it is well known in the industry that large voids will tend to appear in the ingots if premature solidification of the melt is allowed to take place about the upper edges of the mold while the melt in the center of the mold is still molten. As a result, steps are usually taken to stop this premature solidification. The most common method of preventing such premature solidification is to apply a liner of suitable insulation, generally available in the industry in board-like lengths under such names as Hot-Top, Riser, etc., to the upper inside portion of the mold. This insulation then acts to retard heat loss through the mold at its upper end, thereby assuring that the melt will not prematurely freeze on the mold.

There are currently two different types of ingot molds in common use in the steel industry, and the method and means for attaching the insulation liner to the upper inside portion of the mold differs somewhat depending on the type of mold being used.

The first type of mold in common use is a mold of the type which is open at its top end and closed off at its bottom end by a base plate. The vertical walls of the mold are of singular construction and may be disposed so that the mold has a uniform cross-section along its height. Alternatively, the walls of the mold may be tapered so that its interior cross-section changes linearly with height. In this type of ingot mold the layer of insulation is attached to the upper inside surfaces of the mold for a relatively short distance down from the top end of the mold. Various methods and means for attaching the insulation boards to the mold are well known in the art and are described and illustrated in such U.S. Pat. Nos. as: 3,436,883, 4,131,262, 3,797,801, 3,966,167, 3,506,236, 4,083,528, 3,722,848, and 3,002,238.

The second type of ingot mold now in common use, and the one which we are concerned with here, is comprised of two parts. A first part, the mold body, is substantially like the mold described above, i.e. it comprises a structure which is open at its top end and closed off at its bottom end by a base plate. The mold walls may or may not be tapered with height. A second part of the mold, the mold cap, is of similar structure, but it is much shorter in length and open on both ends. It also may or may not have its vertical walls tapered with height. The mold cap is sized and shaped so that it can sit atop the mold body and form a top extension therefore. As a result, when the mold cap and the mold body are properly united to form the complete mold unit, they are together capable of producing a single ingot.

With this second type of ingot mold, the liner of insulation is applied only to the mold cap and not to the mold body. To this end the mold cap is lifted up from its position atop the mold body and inverted so that its lower end (i.e. that end which contacted the mold body when the cap sat atop the body) is made to face upwards. Then the cap is lowered to the ground with this inverted orientation. Next workmen cover the cap's interior surfaces with insulation boards and also part of the cap's now-exposed lower end. The insulation boards are generally held onto the mold cap by large C-shaped wire clips which fit over (and run between) the two ends of the cap so that the insulation boards are captivated between the wire clips and the mold cap. Once the insulation boards have been affixed to the cap via the wire clips, the cap is lifted off the ground, inverted once more so that it reassumes its original orientation (with the now partially-insulated lower end once again facing downward) and then reseated atop the mold body. In this way the two parts of the mold are reunited so as to constitute the complete ingot mold, with the complete ingot mold being lined about its upper inside end with a layer of insulation so that the mold is capable of forming substantially void-free ingots.

Unfortunately, such an arrangement for applying the liner of insulation to the two-piece ingot mold is not entirely satisfactory. In particular, it has been found that the C-shaped wire clips generally used to hold the insulation boards on the cap sometimes slip out of place during the lifting and reinverting of the cap. (In this respect it is to be appreciated that the mold caps are generally quite heavy, typically weighing several tons apiece, and the action of lifting and reinverting the cap can sometimes be quite violent). As a result, the insulation boards can come free from the cap and may fail to form the requisite insulating liner for the cap. This means that the insulation boards must be re-attached to the mold in a time-consuming procedure or, if the insulation detachment goes unnoticed as is often the case, one runs the substantial risk that the ingot produced may have large voids therein.

OBJECTS OF THE PRESENT INVENTION

As a result, the principal object of the present invention is to provide a novel method and means for securely attaching insulation boarding to the mold cap of a two-piece ingot mold in order that the insulation will remain firmly in place when the mold cap is lifted and reinverted prior to reseating on the mold body.

Another object is to provide a novel method and means for securely attaching insulation boarding to the mold cap where the method and means are characterized by low cost, fast operation, and simplicity.

Still another object is to provide a novel method and means for securely attaching insulation boarding to the mold cap which can be used in conjunction with fastener driving tools of the sort shown in U.S. Pat. No. 4,040,554.

SUMMARY OF THE INVENTION

These and other objects are achieved by the present invention, which comprises a novel method and means for attaching insulation boarding to the mold cap of a two-piece ingot mold. A preferred method embodying the present invention comprises the steps of: (1) lifting the mold cap off its seat atop the mold body, (2) inverting the cap so that its lower end (i.e. that end which contacted the mold body when the cap sat atop the body) faces upwards, (3) lowering the cap to a work surface, (4) covering the interior surfaces of the mold cap with a layer of insulation boarding using rectangular pronged straps and a fastening tool, (5) attaching a layer of insulation boarding to part of the mold cap's lower end surface (i.e. that surface which now faces upwards due to the cap's inversion) using S-shaped pronged straps and a fastening tool, (6) lifting the cap off the ground, (7) reinverting the cap so that its now partially-insulated lower end faces downward once more, and (8) reseating the mold cap atop the mold body so that the mold cap and mold body form the complete mold once again.

Each of the rectangular pronged straps comprises a flat rectangular piece of metal stock which has at least one prong extending out of the major plane of the stock. The rectangular pronged straps are used by forcing them against insulation boarding so that the prongs engage the insulation and hold the straps tight against the insulation. Then the insulation boards, with the straps attached, are lifted up to a position adjacent the interior surfaces of the mold cap and the fastening tool is used to drive at least one nail-like fastener into each strap. The shank of each fastener penetrates through the strap, through the insulation, and into the mold cap. At the same time, the straps engage and stop the heads of the fasteners. In this way insulation boards are attached to the interior walls of the mold cap.

Each of the S-shaped pronged straps comprises first, second and third flat portions, with the first portion extending parallel to the third portion and the second portion extending perpendicular to the first and third portions. The third portion includes at least one prong extending out of its major plane. The S-shaped pronged straps are used by forcing them against the insulation boarding and the mold cap so that the first portion of each strap lies adjacent to the exposed end surface of the cap, the second portion extends along the outer edge of an insulation board lying on the end surface of the cap, and the third portion overlies the insulation boarding with at least one prong engaging the insulation. In this way, when a fastening tool subsequently fires a fastener so as to attach the strap's first portion to the mold cap, the insulation will be captivated against movement relative to the mold cap.

BRIEF DESCRIPTION OF THE DRAWINGS

Still other objects and features of the present invention will be further described or rendered obvious in the following detailed description of the preferred embodiment, which is to be considered together with the accompanying drawings wherein like figures refer to like parts and further wherein.

DETAILED DESCRIPTION OF THE PREFERRED EMBODIMENT

Figure 1:
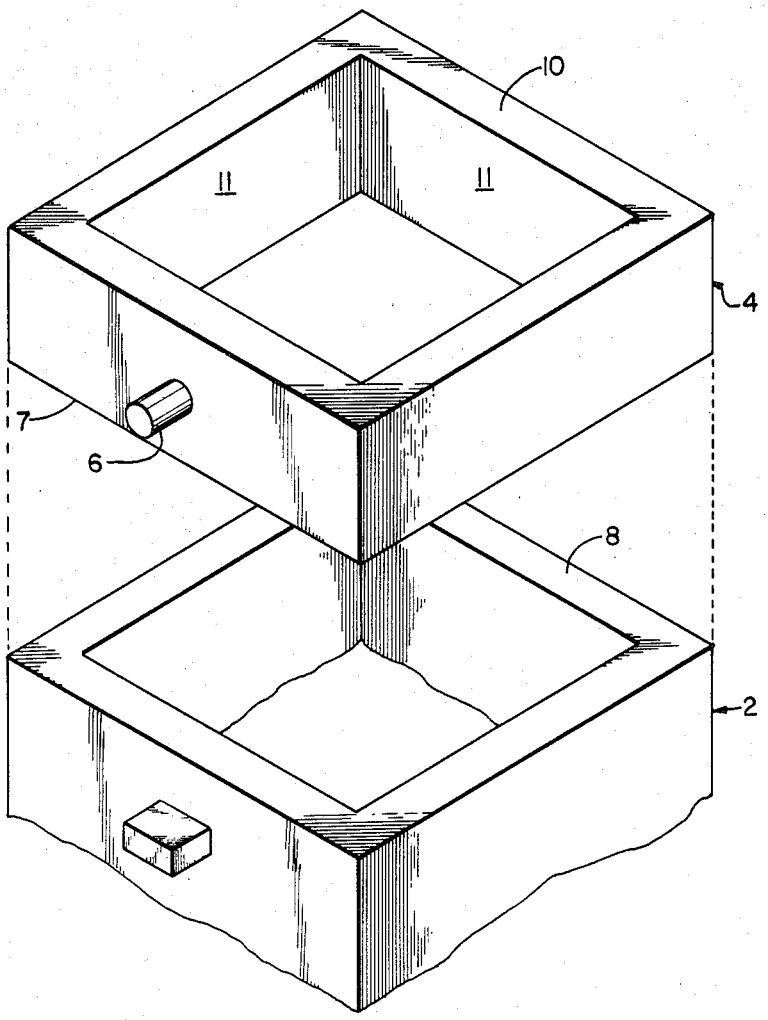
FIG. 1 is a perspective view of a two-piece ingot mold, with part of the mold body broken away and with the mold cap shown in exploded form relative to the mold body.

Looking first to FIG. 1, there is shown a two-piece ingot mold with which the present invention is intended to be used. The mold generally comprises a mold body 2 and a mold cap 4. Mold body 2 is open at its top end and is closed off at its bottom end by a base plate (not shown). The vertical walls of mold body 2 may be parallel or may be disposed so as to form a tapered ingot. Mold cap 4 is of similar structure, but it is much shorter in length and is open on both ends. Cap 4 is sized and shaped so that it can sit atop the body 2 and form a top extension therefore. As a result, when mold body 2 and mold cap 4 are properly united to form the complete mold unit, they are together capable of producing a single ingot.

The present invention comprises a novel method and means for attaching insulation boarding to mold cap 4, in order that the complete ingot mold will be lined about its upper interior surfaces with a liner of insulation and thus be capable of producing substantially void-free ingots.

The first step in the preferred method of attaching the insulation boarding to mold cap 4 consists of raising cap 4 off body 2. For this purpose lifting apparatus such as an overhead crane engages lugs 6 set into the side walls of cap 4 and lifts cap 4 vertically off body 2.

Figure 2:
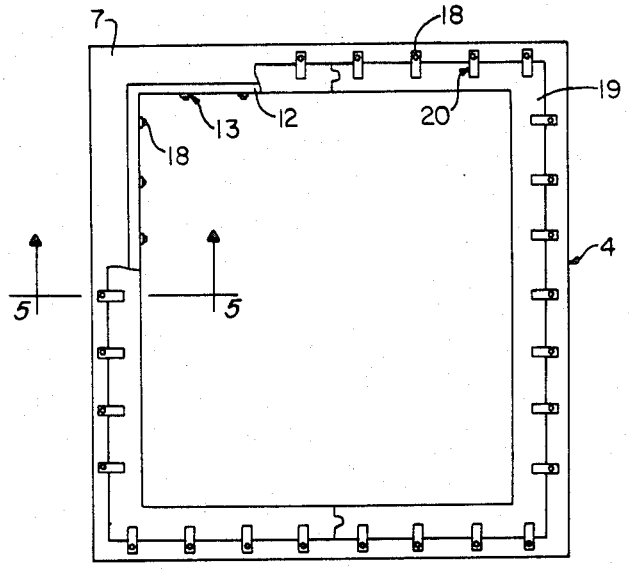
FIG. 2 is a top view with portions cut away showing the bottom end of the mold cap after the mold cap has had insulation added to it in accordance with this invention.
Figure 5:
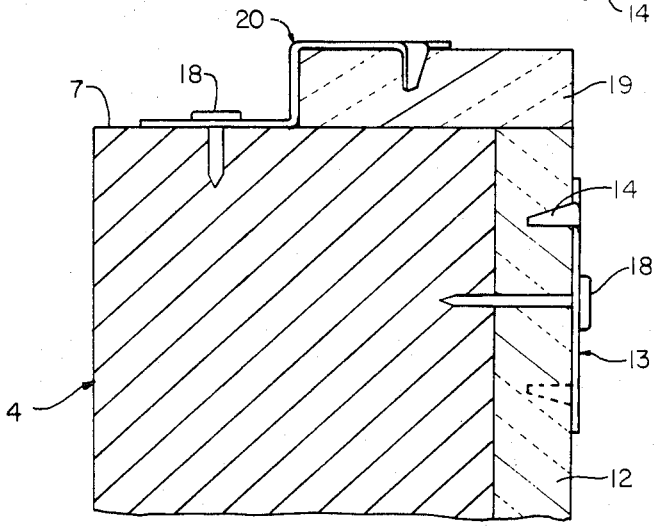
FIG. 5 is a partial side view in section, taken along line 5—5 of FIG. 2.

Once this has been accomplished, cap 4 is inverted so that its bottom surfaces 7 (i.e. those surfaces which previously contacted the top surfaces 8 of body 2) face upwards. This is typically done with the aid of an overhead crane (not shown). See FIGS. 2 and 5.

The next step is to lower cap 4 to a work surface. This is done so that the cap rests on its top surfaces 10 (i.e. those surfaces which formed the top of the complete mold when cap 4 sat atop body 2) and exposes its bottom surfaces 7 upward.

Figure 3:
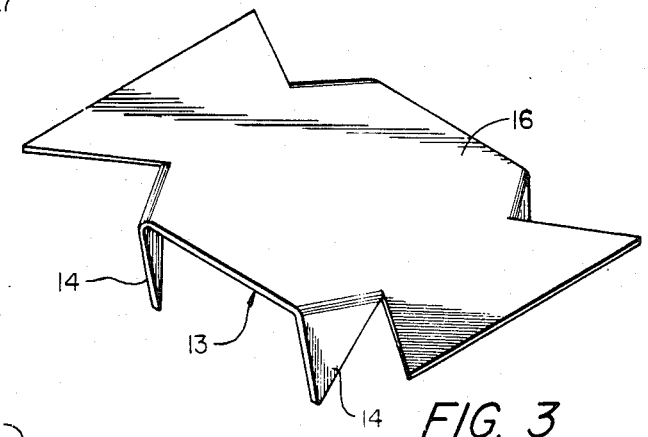
FIG. 3 is a perspective view of a rectangular pronged strap made in accordance with this invention.

Now the inner surfaces 11 of the mold cap are lined with insulation boards 12. For this purpose a plurality of rectangular pronged straps 13 (see FIG. 3) and a fastening tool (not shown) are used. Straps 13 are formed out of sheet stock and are preferably 4 inches long, 2 inches wide, and 1/32 inch thick. Straps 13 are cut back at opposite ends and bent so that each strap has four prongs 14 extending from the main body 16 of the strap. Prongs 14 are preferably about ½ inch long. A plurality of straps 13 are attached to each insulation board 12 by forcing straps 13 towards the insulation board so that the prongs 14 penetrate into the board 12 and hold the main bodies 16 of the clips 13 tight against the boards. Bodies 16 serve as bearing structures so that when a board 12 is held up against the inner surfaces 11 of the mold cap, a nail-like fastener 18 can be driven by the fastener driver so that its shank penetrates through the body 16, through the insulation board 12, and into the wall of the mold cap, while the fastener's head will be engaged by the body 16. In this way insulation boards 12 can be attached to the inner surfaces 11 of cap 4 so that they provide the requisite insulating layer for the mold. See FIGS. 2 and 5. Straps 13 are needed to act as bearing surfaces in this way since the insulation boards 12 are generally quite brittle and soft and are incapable, on their own, of engaging and holding fast the head of a fastener. Preferably the fastener driver used to attach the insulation boards 12 to cap 4 are of the type shown in U.S. Pat. No. 4,040,554.

Figure 4:
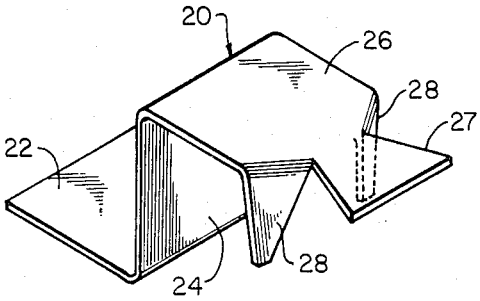
FIG. 4 is a perspective view of a S-shaped pronged strap made in accordance with this invention.

Once the insulation boards 12 have been applied to cover the interior surfaces 11 of mold cap 4, a layer of ring insulation 19 is attached to bottom surfaces 7 of cap 4. For this purpose a plurality of generally S-shaped pronged straps 20 (see FIG. 4) and a fastening tool (not shown) are used. Each of the straps 20 are formed with a first flat portion 22, a second flat portion 24, and a third flat portion 26. Portions 22 and 26 extend parallel to one another, and portion 24 extends perpendicular to portions 22 and 26. Portion 26 is cut back at 27 and bent so that it has a pair of prongs 28 which extend out of the major plane of portion 26. Insulation boards 19 are attached to bottom surfaces 7 by first laying them on top of the surfaces 7 so that they overlie the previously attached insulation boarding 12 which lines the interior surfaces 11 of cap 4 (see FIGS. 2 and 5). Insulation boards 19 are sized relative to mold cap 4 so that when they overlie the insulation boards 12 in the manner shown in FIGS. 2 and 5, they will still leave exposed a substantial portion of the end surfaces 7 of the cap. Then a plurality of straps 20 are disposed about surfaces 7 and boards 19 so first portions 22 engage the exposed end surfaces 7 of cap 4, second portions 24 extend along the outer edges of the insulation boards 19, and third portions 26 overlie the insulation boarding with the two prongs 28 being forced into and securely engaging the insulation boards. As a result, when fasteners 18 are subsequently fired through first portions 22 and into the cap 4 by a fastener driver, the straps 20 (and hence the insulation boarding 19) are securely attached to the cap 4. See FIGS. 2 and 5. Preferably the fastener driver used is a fastener driver of the sort shown in U.S. Pat. No. 4,040,554.

Once all the insulation boarding has been attached to cap 4 in the manner previously described, the next step is to lift up cap 4 once more via lugs 6 (and well-known lifting apparatus, not shown).

Next cap 4 is reinverted, so that cap 4 is returned to its original orientation whereby bottom surfaces 7 (which bear the insulation boards 19) face downward once more. This is accomplished by means of apparatus (not shown) well known in the art.

Finally, cap 4 is reseated securely atop mold base 2 so that the complete mold is once again assembled and ready for casting an ingot substantially free of large voids.

MODIFICATIONS OF THE PREFERRED EMBODIMENT

It will be appreciated that the preferred embodiment described above may be modified in numerous ways without departing from the scope of the present invention. Thus, for example, one might form S-straps 20 with more or less than the two prongs 28 shown, or one might form prongs 28 by punching tangs out of the central regions of third portions 26.

Figure 6:
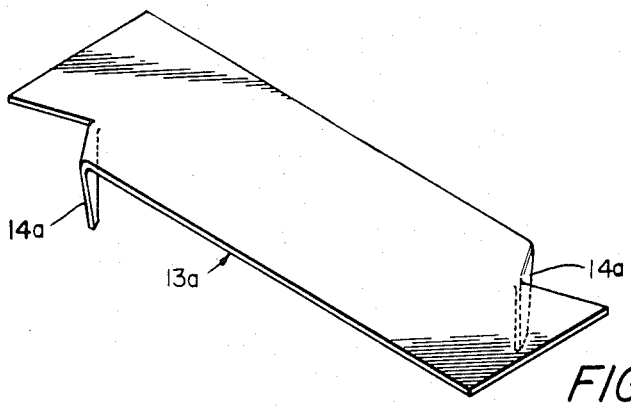
FIG. 6 is a perspective view of an alternate form of rectangular pronged strap made in accordance with this invention.

Alternately, one might form the rectangular straps 13 with more or less than the four prongs 14 shown (FIG. 6 shows one such embodiment), or one might form prongs 14 by punching tangs out of the main body 16.

It is also envisioned that one might employ the present invention with a two-piece mold having a cross-sectional shape other than rectangular, e.g. hexagonal.

It is also contemplated that one might use a fastener driving tool other than one of the type shown in U.S. Pat. No. 4,040,554 when practicing the invention.

Still other modifications will be obvious to those skilled in the art and are considered to be within the scope of this invention.

ADVANTAGES OF THE INVENTION

The primary advantage gained by using the present invention is that insulation boarding can now be securely attached to the mold cap so that the insulation is not jarred out of place when the cap is lifted and inverted prior to reseating on the mold body. As a result, ingots may be cast which are substantially free of large voids.

The present invention also offers the advantages of low cost, fast operation, and simplicity.

Still another advantage is that the present invention can be practiced using fastener driving tools of the sort shown in U.S. Pat. No. 4,040,554.

What I claim is:

1. A clip for fastening insulation to a mold, said clip comprising first, second and third portions each having first and second opposite sides, said first and third portions being integral with opposite ends of said second portion, said second portion extending (a) away from said first side of said first portion at a right angle, and (b) away from said second side of said third portion at a right angle, and said third portion having at least one tang projecting outward from said second side thereof, in order that when a board-like piece of insulation is placed against a surface of a mold, said clip may be pressed against said mold and said insulation so that said second side of said first portion of said clip will engage said mold surface while said second side of said second portion of said clip and said second side of said third portion of said clip will engage said insulation and said at least one tang will penetrate into said insulation, whereby said clip will hold said insulation to said mold when said first portion of said clip is attached to said mold.

* * * * *